US009766050B2

(12) United States Patent
Bergmann et al.

(10) Patent No.: US 9,766,050 B2
(45) Date of Patent: Sep. 19, 2017

(54) SMALL CALIBER SHAPED CHARGE ORDNANCE

(71) Applicant: NAECO, LLC, Peachtree City, GA (US)

(72) Inventors: David Bergmann, Fayetteville, GA (US); Frederick Carlisle Bergmann, Fayetteville, GA (US)

(73) Assignee: NAECO, LLC, Peachtree City, GA (US)

( * ) Notice: Subject to any disclaimer, the term of this patent is extended or adjusted under 35 U.S.C. 154(b) by 0 days.

(21) Appl. No.: 15/184,075

(22) Filed: Jun. 16, 2016

(65) Prior Publication Data

US 2017/0089678 A1 Mar. 30, 2017

Related U.S. Application Data

(60) Provisional application No. 62/181,926, filed on Jun. 19, 2015.

(51) Int. Cl.

| | |
|---|---|
| ***F42B 10/00*** | (2006.01) |
| ***F42B 12/10*** | (2006.01) |
| ***F42C 1/02*** | (2006.01) |
| *F42B 5/02* | (2006.01) |
| *F42B 30/02* | (2006.01) |

(52) U.S. Cl.

CPC ..... *F42B 12/10* (2013.01); *F42C 1/02* (2013.01); *F42B 5/02* (2013.01); *F42B 12/105* (2013.01); *F42B 30/02* (2013.01)

(58) Field of Classification Search

CPC ..... F42B 12/10; F42C 1/04

USPC ..... 102/439, 473, 306–310

See application file for complete search history.

(56) References Cited

U.S. PATENT DOCUMENTS 1,444,571 A * 2/1923 Stoops ..... E21B 43/263 102/473
2,672,094 A * 3/1954 Roberts ..... F42B 12/10 102/241
2,697,400 A * 12/1954 Liljegren ..... F42B 12/10 102/245
2,764,092 A * 9/1956 Massey ..... F42C 1/10 102/204
3,318,244 A * 5/1967 Rostocil ..... F42B 5/16 102/436
3,623,432 A * 11/1971 Schminke ..... F42B 12/10 102/259
3,710,716 A * 1/1973 Davis ..... F42B 12/10 102/223

(Continued)

*Primary Examiner* — Samir Abdosh
(74) *Attorney, Agent, or Firm* — Woodard, Emhardt, Moriarty, McNett & Henry LLP

(57) ABSTRACT

This application discloses a shaped charge firearm projectile that includes a two-piece jacket that defines an internal cavity with an opening in the front side of the jacket that is part of the internal cavity, a detonator positioned in the internal cavity, a striker passing through the opening with one end positioned outside of the internal cavity and the other end positioned near the detonator inside of the internal cavity positioned to detonate the detonator when the striker impacts a target with sufficient force, and a main charge positioned in the internal cavity with the main charge and the jacket defining an air-filled chamber located between the front side of the jacket and the main charge, where the striker extends into the main charge.

21 Claims, 6 Drawing Sheets

(56) References Cited

U.S. PATENT DOCUMENTS

| | | | | | |
|---|---|---|---|---|---|
| 3,777,663 | A * | 12/1973 | Brown | F42B 3/08 102/306 |
| 3,842,742 | A | 10/1974 | Harnau | |
| 4,610,204 | A | 9/1986 | Dunne | |
| 4,672,896 | A | 6/1987 | Precoul | |
| 4,793,256 | A | 12/1988 | Webb | |
| 4,833,994 | A * | 5/1989 | Strobush | F42B 12/18 102/272 |
| 4,938,146 | A * | 7/1990 | Gunther | F42B 12/10 102/430 |
| 4,955,938 | A | 9/1990 | Romer | |
| 4,969,397 | A | 11/1990 | Gunther | |
| 5,000,094 | A | 3/1991 | Sullivan | |
| 5,565,647 | A | 10/1996 | Kerdraon | |
| 6,408,765 | B1 | 6/2002 | Tauber | |
| 7,021,187 | B1 | 4/2006 | Grassi | |
| 7,654,458 | B1 | 2/2010 | Kokodis | |
| 8,522,682 | B1 | 9/2013 | Genson | |
| 2005/0235859 | A1 * | 10/2005 | Myers, Jr. | F42B 1/02 102/307 |

* cited by examiner

SMALL CALIBER SHAPED CHARGE ORDNANCE

CROSS-REFERENCE TO RELATED APPLICATIONS

This application claims priority to and the benefit of U.S. provisional patent application, Ser. No. 62/181,926, filed on Jun. 19, 2015, which is incorporated by reference herein as if fully set forth at length.

BACKGROUND

This disclosure is in the field of shaped charge ordnance.

DESCRIPTION OF THE ILLUSTRATED EMBODIMENTS

Figure 1:
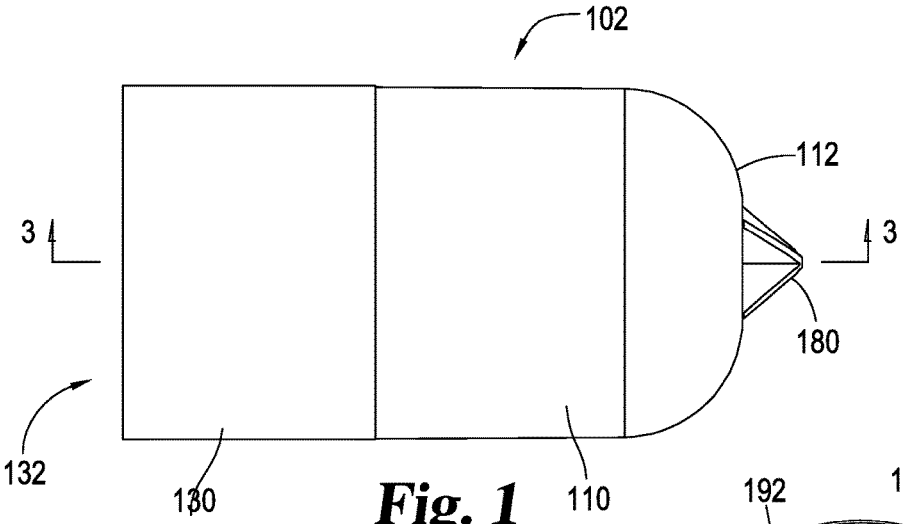
FIG. 1 is a side elevational view of a projectile incorporating a shaped charge.

For the purposes of promoting an understanding of the principles of what is claimed, reference will now be made to embodiments illustrated in the drawings and specific language will be used to describe the same. It will nevertheless be understood that no limitation of the scope of the claims is thereby intended. Any alterations and further modifications in the illustrated device, and any further applications of the principles disclosed and illustrated herein are contemplated as would normally occur to one skilled in the art to which the disclosure relates.

With respect to the specification and claims, it should be noted that the singular forms "a", "an", "the", and the like include plural references unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Disclosed is a small caliber projectile that incorporates a shaped charge explosive as part of the projectile ordnance. For purpose of this application small caliber refers to calibers that are utilized in handheld weaponry and can be fired as alternative rounds in standard handheld weapons. For example, a ten or twelve gauge shotgun shell, a large caliber handgun shell up to .50 caliber (0.50" (12.7 mm) barrel bore), or a large caliber rifle cartridge up to .50 caliber (0.50" (12.7 mm) barrel bore). For purpose of this application, small caliber does not refer to larger rounds that may be adapted to be fired from specialized weapons that may be man portable. Examples of man portable large caliber weapons that are not included in this definition of small caliber weapons includes grenade launchers such as the M203, a 40 mm under barrel grenade launcher; rifle grenades such as the 22 mm M7 which was fitted on the end of the barrel of a rifle; and rocket-propelled grenades that use a rocket motor to fire rockets equipped with explosive warheads. For purpose of this application, projectile means a bullet adapted to be fired out of a firearm barrel which is propelled by pressure, such as created by the ignition of a propellant in the firearm barrel with the bullet filling the bore of the barrel. "Projectile" does not include rockets.

The planned purpose for the projectile incorporating a shaped charged explosive is to provide the foot soldier limited capacity to penetrate objects that the soldier's primary weapon cannot penetrate while not requiring the soldier to carry extra weaponry. The disclosed projectile only includes a small shaped charge, so the penetration capacity of the disclosed projectile is limited, particularly when compared to larger caliber shaped charges (generally, the penetration depth of a shaped charge is a function of the diameter of the shaped charge). However, increased penetration capacity, even limited, is of potential value. For example, the disclosed projectile may be useful against lightly armored vehicles, body armor, and some obstacles that may be used as cover, for example, cinderblocks. The disclosed projectile is similar in size to standard cartridges, so an individual could carry a small number of the disclosed projectiles without sacrificing significant capacity of regular ammunition. Alternate applications include High Explosive or Fragmentation loadings of the projectile.

Figure 2:
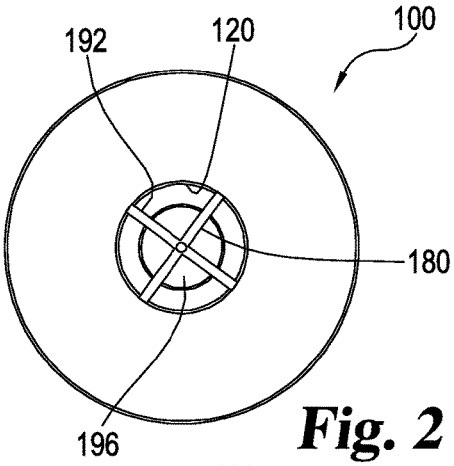
FIG. 2 is a front elevational view of the projectile of FIG. 1.
Figure 3:
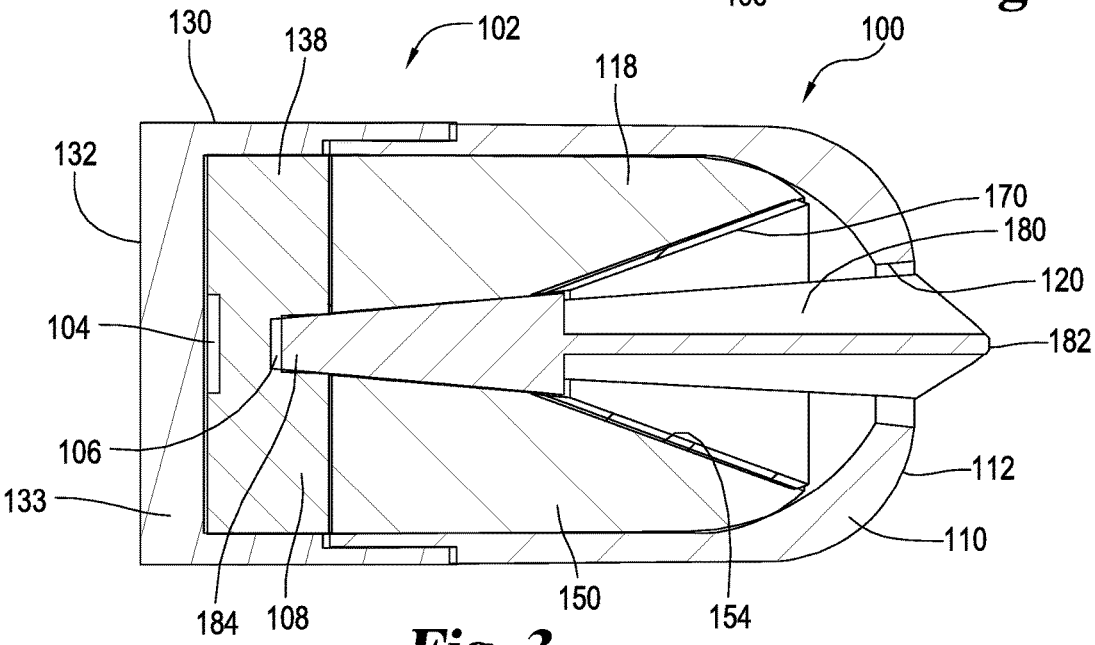
FIG. 3 is a side elevational cross-sectional view of the FIG. 1 projectile taken along line 3-3.

Referring to FIGS. 1-3, projectile 100 is illustrated. Projectile 100 generally includes jacket 102, main charge 150, liner 170, striker 180, detonator 104 and/or 106 and may optionally also include booster charge 108. In the illustrated embodiment, jacket 102 is separable into two components, front section 110 and rear section 130.

Booster charge 108 is optionally included when necessary to ignite main charge 150. Main charge 150 may be constructed of a comparatively insensitive high explosive that requires a relatively large amount of heat or pressure to detonate, in particular, more heat or pressure than could reasonably be expected from detonator 104. In one example, main charge 150 is a plastic explosive that would not reliably be detonated by detonator 104. Booster charge 108 may be comparatively more sensitive to detonation, and, in particular, be sufficiently sensitive to detonation to be detonated by detonator 104. In one example, booster charge 108 is gunpowder.

Figure 4:
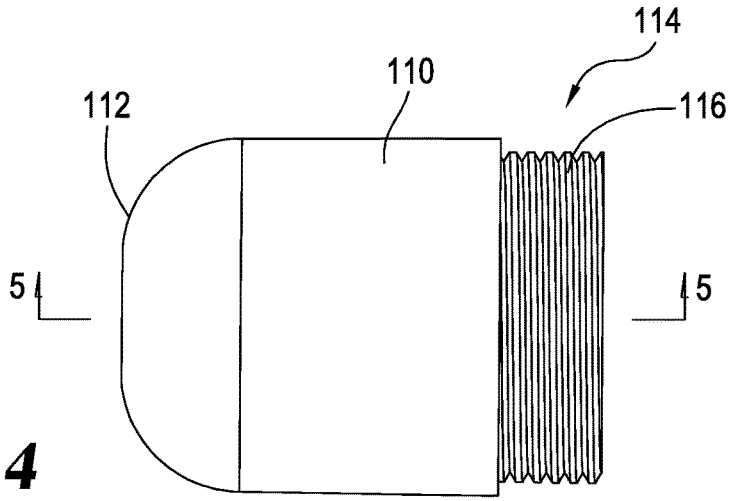
FIG. 4 is a side elevational view of the front section of the projectile jacket, a component of the FIG. 1 projectile.
Figure 5:
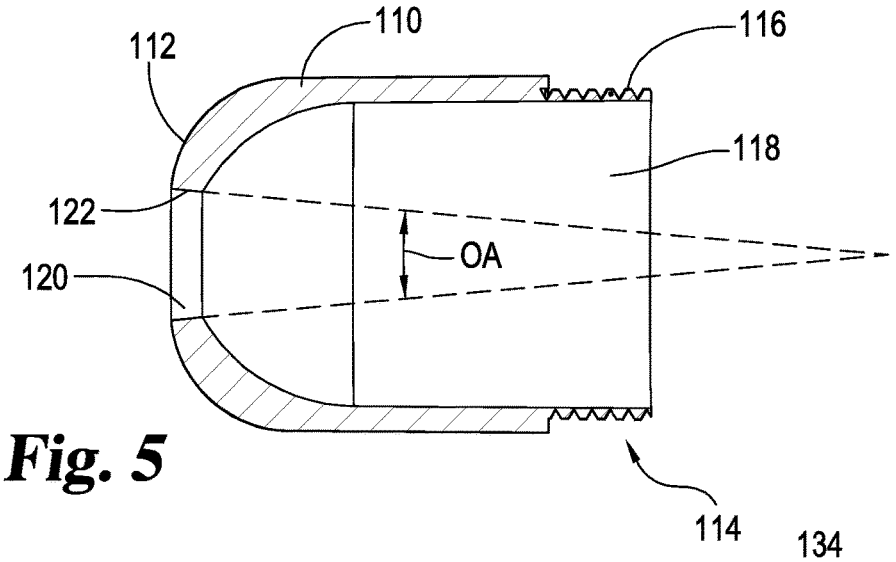
FIG. 5 is a front elevational cross-sectional view of the FIG. 4 front section taken along line 5-5.

Referring to FIGS. 4-5, front section 110 is illustrated. Front section 110 includes front side 112, connecting portion 114 which includes external threads 116. Front section 110 defines internal cavity 118 and surface 122 which defines opening 120 on front side 112. Surface 122 has a conical profile and defines conic angle OA.

Figure 6:
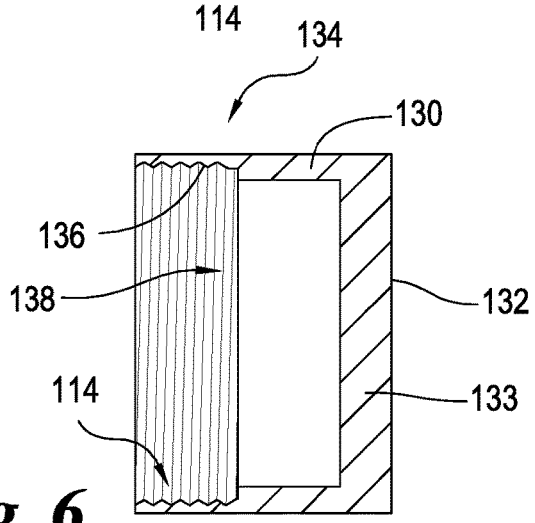
FIG. 6 is a side elevational view of the rear section of the jacket, a component of the FIG. 1 projectile.

Referring to FIG. 6, rear section 130 is illustrated. Rear section 130 includes rear side 132, connecting portion 134 which includes internal threads 136. Rear section 130 defines internal cavity 138. Internal threads 136 are constructed and arranged to be removably coupled with external threads 116 on front section 110 to permit jacket 102 to be assembled as illustrated in FIGS. 1-3.

Front section 110 and rear section 130 are removably coupled together to facilitate positioning main charge 150, liner 170 and striker inside internal cavities 118 and 138 in jacket 102. While the illustrated embodiment utilizes a threaded connection between front section 110 and rear section 130, it should be understood that other structures to removably couple front section 110 and rear section 130 may be utilized. For example, connection portions 114 and 134 may define an interference fit, where front section 110 and rear section 130 are pressed together and then held together by friction. In yet another example, front section 110 and rear section 130 may be bonded together utilizing an adhesive or other material joining methods. Furthermore, the coupling between front section 110 and rear section 130 does not need to be removable. Once assembled, front section 110 and rear section 130 may be permanently coupled together.

Figure 7:
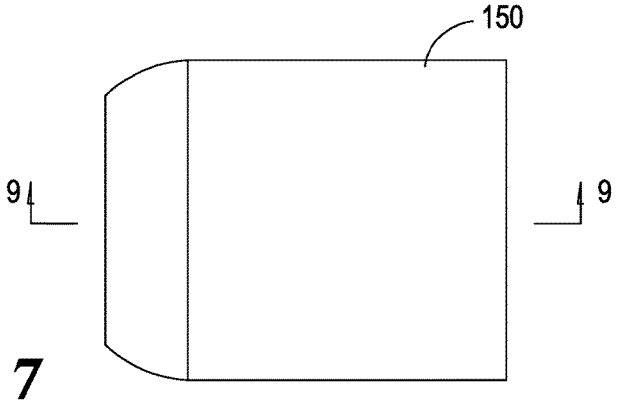
FIG. 7 is a side elevational view of the main charge, a component of the FIG. 1 projectile.
Figure 8:
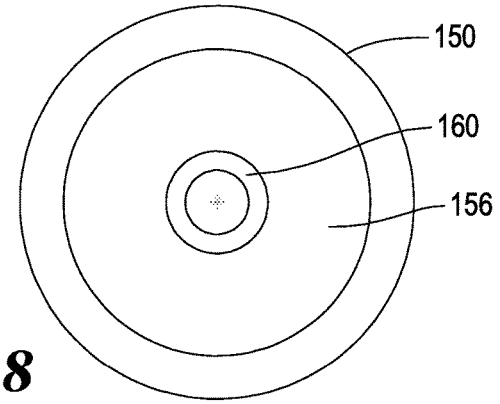
FIG. 8 is a front elevational view of the FIG. 7 main charge.
Figure 9:
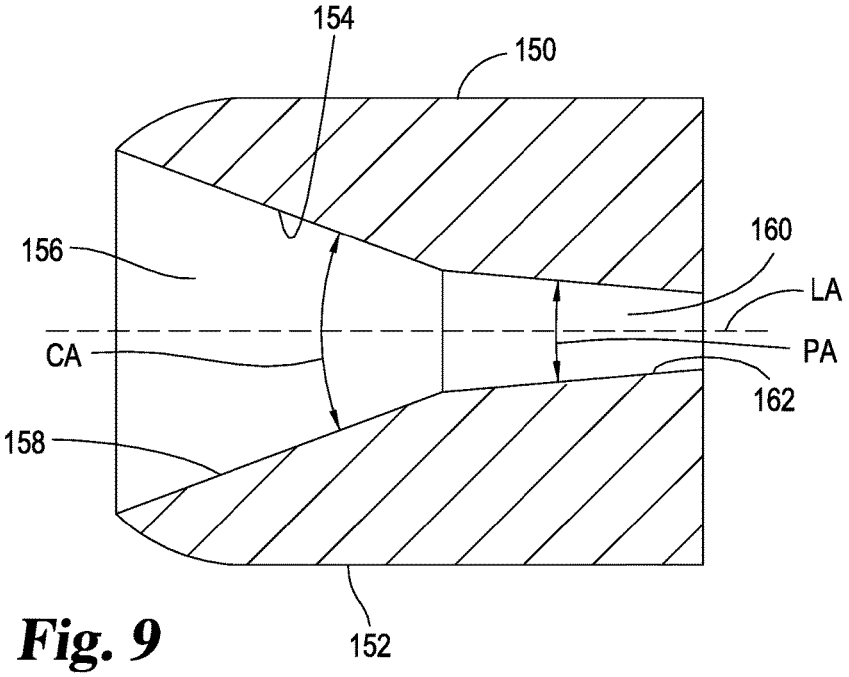
FIG. 9 is a top plan cross-sectional view of the FIG. 7 main charge taken along line 9-9.

Referring to FIGS. 7-9, main charge 150 is illustrated. In general, main charge 150 is an explosive charge constructed of a material with sufficient viscosity or structural strength to hold its shape at room temperature. For example, plastic explosive such as C4, HMX, OCTOL, RDX-based compositions or any other appropriate explosive composition. Main charge 150 includes outer surface 152 and inner surface 154. Inner surface 154 defines air-filled chamber 156 having conical profile 158 and passageway 160 having conical profile 162. Conical profile 158 has a conic angle CA while conical profile 162 has a conic angle PA. Main charge 150 is constructed and arranged to function as a shape charge with air-filled chamber 156 to focus the explosive energy of main charge 150 forward along longitudinal access LA through the air-filled chamber 156.

Figure 10:
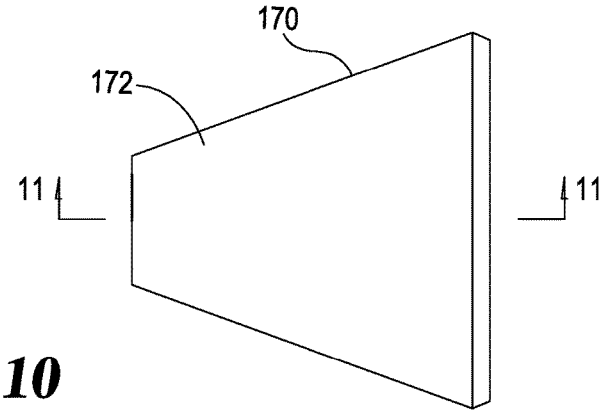
FIG. 10 is a side elevational view of a liner, a component of the FIG. 1 projectile.
Figure 11:
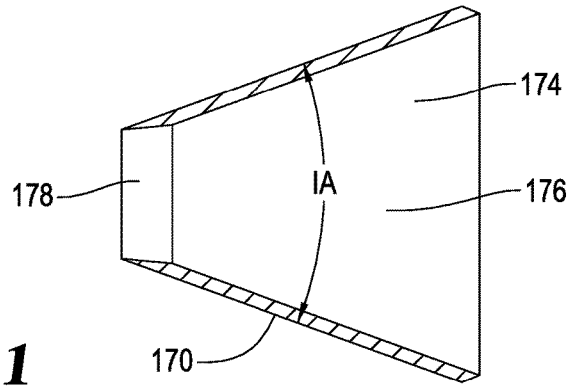
FIG. 11 is a top plan cross-sectional view of the FIG. 10 liner taken along line 11-11.

Referring now to FIGS. 10-11, liner 170 is illustrated. Liner 170 includes outer surface 172 and inner surface 174 with inner surface 174 defining air-filled chamber 176 and opening 178. Outer surface 172 is constructed and arranged to mate flush against inner surface 154 on main charge 150 as illustrated in FIG. 3. Liner 170 is constructed and arranged to be propelled forward by detonation of main charge 150 as part of a jet of high velocity particles. Liner 170 may be constructed from many materials including metals or glass. One common choice is copper, or copper alloys, which have been determined to provide good penetration when used as part of a shape charge warhead. Another choice is powder metallurgical metals such as tungsten or molybdenum.

Figure 12:
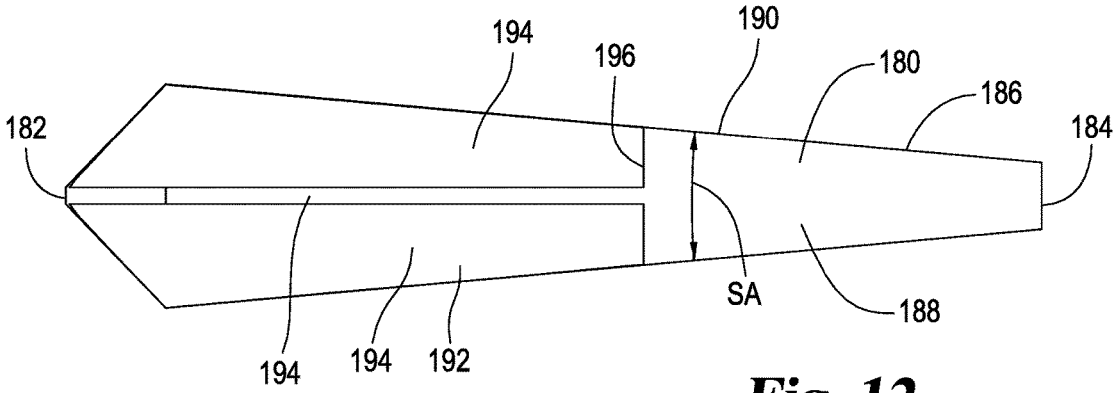
FIG. 12 is a side elevational view of a striker, a component of the FIG. 1 projectile.
Figure 13:
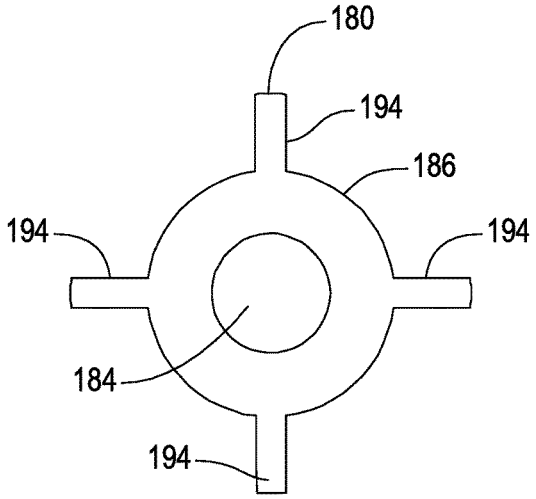
FIG. 13 is a rear elevational view of the FIG. 12 striker.
Figure 14:
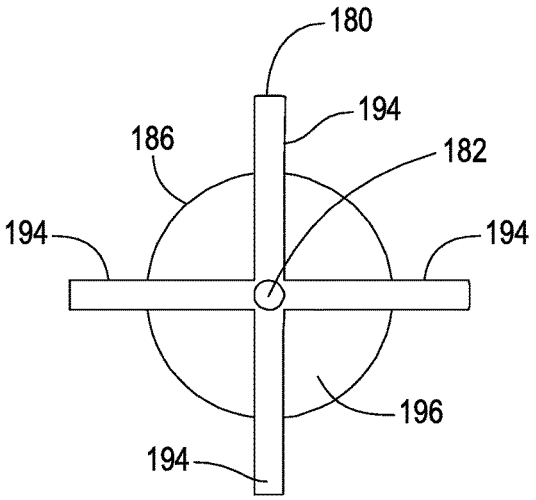
FIG. 14 is a front elevational view of the FIG. 12 striker.
Figure 15:
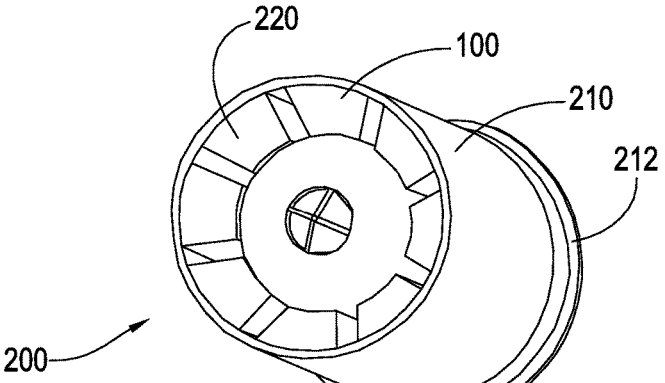
FIG. 15 is a perspective view of a shotgun shell incorporating the FIG. 1 projectile.
Figure 16:
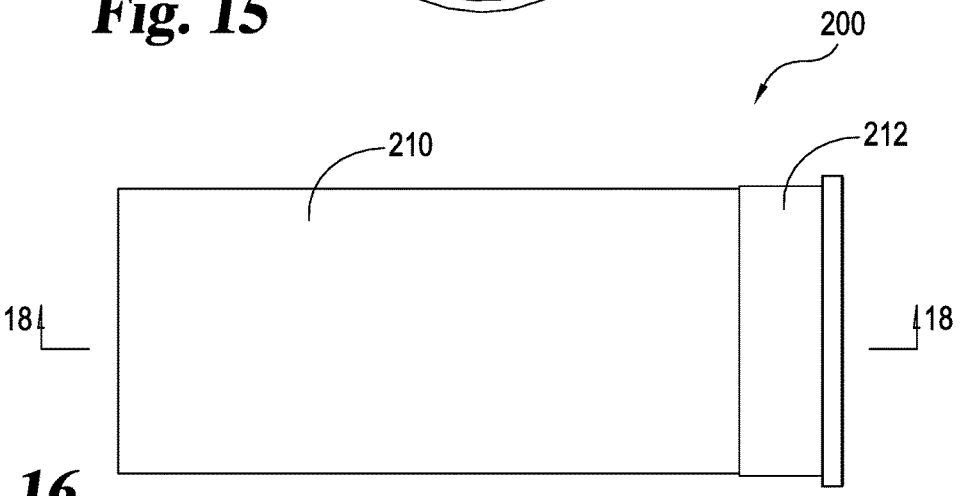
FIG. 16 is a side elevational view of the FIG. 15 shot gun shell.
Figure 17:
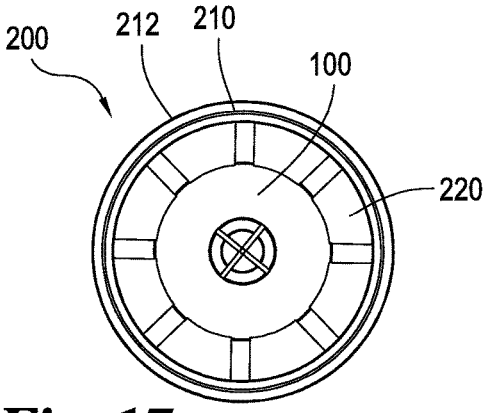
FIG. 17 is a front elevational view of the FIG. 15 shot gun shell.

Referring to FIGS. 12-14, striker 180 is illustrated. Striker 180 includes forward end 182, rearward end 184 and outer surface 186. Striker 180 has a rear portion 188 and forward portion 192. Rear portion 188 defines conical profile 190 and forward portion 192 includes a plurality of flutes 194 and the transition between forward portion 192 and rear portion 188 is defined by shoulder 196. While four flutes 194 are illustrated, any other number could be used. Flutes 194 are used to maximize the buckling and compressive strength of striker 180 while minimizing the area taken up by striker 180 of air-filled chamber 176.

Referring again to FIGS. 1-3, projectile 100 is assembled with main charge 150 positioned inside internal cavity 118 with liner 170 abutting inner surface 154. Striker 180 passes completely through main charge 150 and liner 170 with forward end 182 protruding outside front side 112 and rearward end 184 positioned near detonator 104 or 106, with detonator 104 or 106 positioned near rear wall 133. For purpose of this disclosure, "near" means close, but not necessarily adjacent. Detonator 104 or 106 is positioned such that, when striker 180 is driven rearwardly toward rear wall 133, detonator 104 or 106 is positioned between striker 180 and rear wall 133 so that striker 180 compresses detonator 104 or 106 between rearward end 184 and rear wall 133.

Projectile 100 is arranged to be fired in a forward direction such that front side 112 and striker 180 are the first surfaces of projectile 100 to impact a target. As illustrated in FIGS. 1 and 3, forward end 182 of striker 180 protrudes beyond front side 112 of jacket 102. If forward end 182 of striker 180 impacts a sufficiently rigid target, striker 180 will be driven rearwardly with respect to jacket 102 and main charge 150 until rearward end 184 of striker 180 compresses detonator 104 or 106 against rear wall 133 of jacket 102. If striker 180 impacts detonator 104 or 106 against rear wall 133 with sufficient force, then detonator 104 or 106 will ignite and ignite booster charge 108 which thereby will ignite main charge 150 which propels liner 170 and possibly striker 180 forward in a jet of particles.

Projectile 100 includes several structural features that work as safety mechanisms to reduce or prevent detonation of projectile 100 in situations besides when projectile 100 impacts a sufficiently rigid structure after being fired. Opening 120, through which striker 180 extends, includes conical profile 122 having conic angle OA. Conic angle OA may be substantially the same as conic angle SA on striker 190, with opening 120 sized such that striker 180 abut opening 120 and cannot translate past opening 120 without opening 120 and/or flutes 194 on striker 180 deforming. This construction helps prevent unintended detonation of detonator 104 or 106 in situations where striker 190 is impacted with less force, such might be encountered were projectile 100 to be dropped from height onto striker 190.

Similarly, conic angle $\alpha$A in main charge 150 may be substantially the same as conic angle SA on striker 190, with passageway 160 sized such that striker abuts passageway 160 and cannot move through passageway 160 without deforming main charge 150 (and enlarging passageway 160). As described above, main charge 150 may be constructed of a plastic explosive, which can be deformed with sufficient force. Main charge 150 is restrained from deforming because it is enclosed in jacket 102. Thus, for striker 190 to move through main charge 150, main charge 150 and possibly jacket 102, have to deform. This construction may also help reduce or prevent unintended detonation of detonator 104 or 106 in situations where striker 190 is impacted with less force than generated from impact after firing from a firearm. In addition, the act of firing projectile 100 may generate significant reward momentum on striker 190, which would move striker 190 rearwardly if it is not sufficiently restrained. However, when projectile 100 is within a barrel of a firearm, jacket 102 is axially restrained from deforming, which also restrained main charge 150 from deforming axially. The illustrated construction may prevent detonations within a firearm barrel (due to striker 190 impacting detonator 104 or 108 against rear wall 133), which is an important safety consideration.

While a mating conical profile is disclosed, other geometries of striker 190 and/or passageway 160 may be used to achieve a similar effect. Any variable geometry of either striker 190, passageway 160 or both that resists longitudinal movement of striker 190 in a rearward direction through main charge 150 could be used. For example, a portion of striker 190 in passageway 160 could have an enlarged portion that would require deformation of main charge 150 for striker 190 to move rearward.

Referring now to FIGS. 15-18, shotgun shell 200 is illustrated. Shotgun shell 200 includes projectile 100, hull 210, head 212, primer 214, propellant charge 216, base 218 and sabot 220. Shotgun shell 200 is assembled with propellant charge 216, base 218, projectile 100 and sabot 220 contained within hull 210 and base 218 with primer 214 passing through base 212. Hull 210 may be crimped around sabot 220 to retain all the components within hull 210 and base 218. Primer 214 and propellant charge 216 are conventional propellants for a shotgun shell. When primer 214 is impacted by a firing pin, it detonates propellant charge 216.

Base 218 serves to separate propellant charge 216 from sabot 220 and projectile 100 and provides a seal that prevents gases from detonating propellant charge 216 from flowing around sabot 220 and projectile 100 rather than propelling them down the barrel of the firearm.

Sabot 220 consists of several pieces that surround projectile 100 in hull 210. When shotgun shell 200 is fired, sabot 220 carries projectile 100 down the barrel of the firearm. When the sabot reaches the end of the barrel, the still air pulls sabot 220 apart and away from projectile 100, allowing projectile to continue in flight, unimpeded by sabot 220. Sabot 220 may be made of a lightweight material (compared to projectile 100) such as plastic. Sabot 220 allows the outer diameter of projectile 100 to be smaller than the bore of the shotgun, which can reduce the weight of projectile 100 and affects the amount of propellant charge 216 that is required to fire projectile 100. Different shotgun barrels fail when too much propellant is used, so sabot 220 allows the weight of projectile 100 to be matched with the capacity of a particular shotgun. Sabot 220 also permits shotgun shell 200 to be used in shotguns having rifled barrels. However, it should be understood that sabot 220 is optional. The outer diameter of projectile 100 could be sized to fill the internal diameter of hull 210 (and the bore of the shotgun barrel) and might optionally include rifling features.

Figure 20:
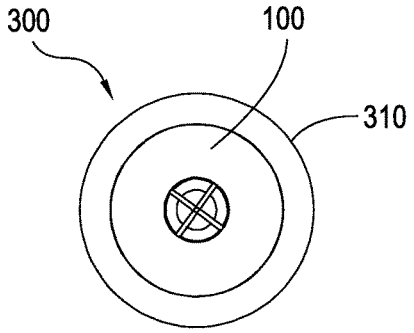
FIG. 20 is a top plan view of the FIG. 19 cartridge.
Figure 18:
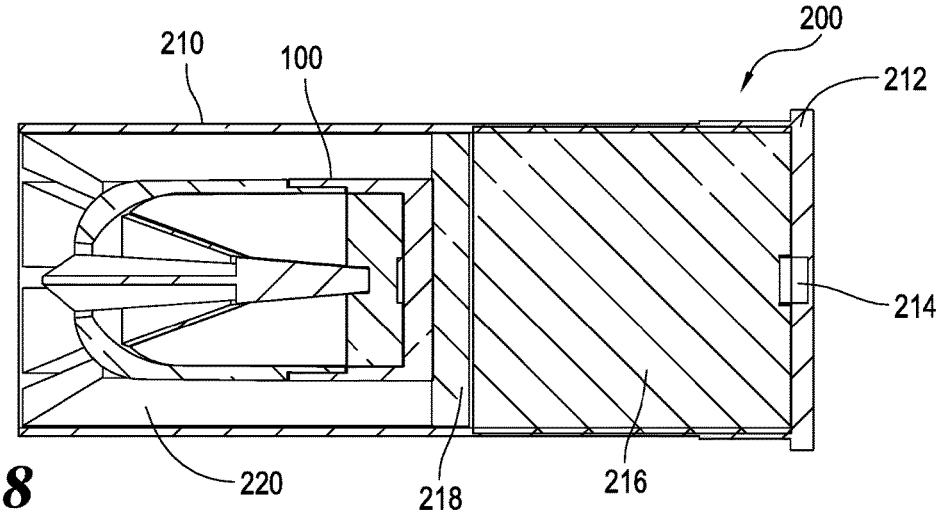
FIG. 18 is a top plan cross-sectional view of the FIG. 15 shot gun shell taken along line 18-18 in FIG. 16.
Figure 19:
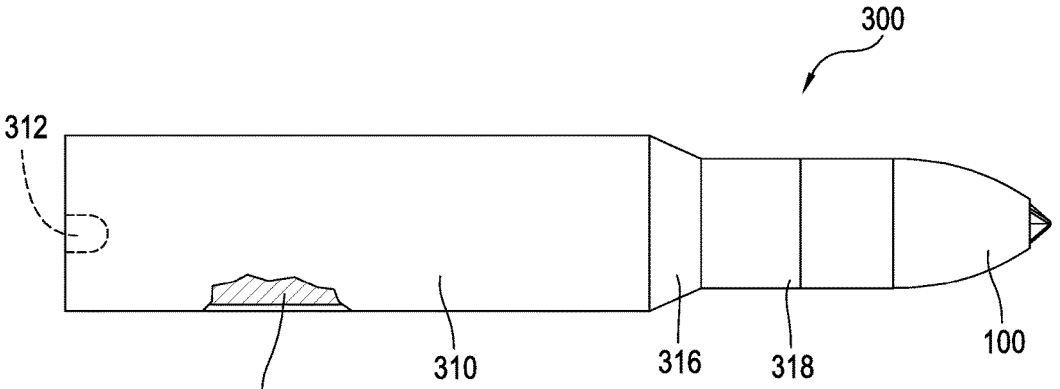
FIG. 19 is a side elevational view of a cartridge incorporating the FIG. 1 projectile.

Referring to FIGS. 19 and 20, cartridge 300 is illustrated. Cartridge 300 is a large bore rifle cartridge that incorporates projectile 100 as the bullet. Cartridge 300 includes case 310, primer 312 and propellant charge 314. Case 310 defines neck 316 and crimp 318 around projectile 100. Case 310 and projectile 100 cooperate to contain propellant charge 314 within case 310.

While the claimed subject matter has been illustrated and described in detail in the drawings and foregoing description, the same is to be considered as illustrative and not restrictive in character. All changes and modifications that come within the spirit of the disclosure are desired to be protected by the claims.

We claim:

1. A firearm projectile comprising:

a jacket comprising a first piece and a second piece removably coupled to the first piece, wherein the jacket defines a front side on the second piece, a rear side on the first piece, an internal cavity and an opening in the front side of the second piece contiguous with the internal cavity;

a detonator positioned in the internal cavity defined by the jacket;

a striker having a first end and a second end, wherein the striker is positioned partially inside the internal cavity defined by the jacket, with the striker passing through the opening on the front side with the first end positioned outside of the internal cavity and with the second end positioned near the detonator inside of the internal cavity, wherein the striker is constructed and arranged to detonate the detonator when the striker impacts a target with sufficient force, and wherein the striker is constructed and arranged to compress the detonator between the second end of the striker and the rear side of the jacket; and a main charge positioned within the internal cavity defined by the jacket, wherein the main charge and the jacket define an air-filled chamber located between the front side of the jacket and the main charge, wherein the striker extends into the main charge.

2. The projectile of claim 1, wherein the air-filled chamber defined by the main charge is constructed and arranged to focus the blast energy of the main charge toward the front side of the projectile.

3. The projectile of claim 2, wherein the main charge defines a substantially conical surface against the air-filled chamber.

4. The projectile of claim 1, further comprising a non-explosive liner abutting the main charge in the air-filled chamber.

5. The projectile of claim 4, where the non-explosive liner is constructed from a ductile metal.

6. The projectile of claim 1, further comprising:

a booster charge positioned near the main charge and near the detonator in the internal cavity defined by the jacket.

7. The projectile of claim 1, wherein the first end of the striker is larger than the opening on the front side of the second piece of the jacket such that the first end cannot pass through the opening without either the first end or the opening deforming.

8. The projectile of claim 7, wherein the jacket and the striker cooperatively form a delayed arming mechanism that prevents the striker from detonating the detonator when the projectile is initially fired, wherein the jacket and the striker are constructed and arranged such that, when the projectile is fired, the striker accelerates with the projectile without the jacket or the striker deforming sufficiently for the first end to pass through the opening in the jacket.

9. The projectile of claim 1 wherein a frustoconical portion of the striker defines a frustoconical outer surface.

10. The projectile of claim 9, wherein the frustoconical portion of the striker and the main charge cooperatively form a safety that prevents the striker from detonating the detonator unless the striker impacts a surface that imparts sufficient force to the striker such that the frustoconical portion deforms the main charge and moves relative to the main charge thereby permitting the striker to impact and detonate the detonator.

11. The projectile of claim 9, wherein the frustoconical portion of the striker, the main charge and the jacket cooperatively form a safety that prevents the striker from detonating the detonator unless the striker impacts a solid surface with sufficient force to deform the main charge and the jacket to permit the frustoconical portion of the striker to move relative to the main charge for the striker to impact and detonate the detonator.

12. The projectile of claim 1, wherein the detonator is positioned near the rear side of the jacket.

13. The projectile of claim 1, wherein the first end of the striker defines a finned portion constructed and arranged to minimize the volume occupied by the first end in the air-filled chamber while maintaining sufficient rigidity to not significantly deform on the initial impact when the striker impacts a solid surface.

14. A shotgun shell assembly comprising:

the projectile of claim 1;

a shotgun shell; and a propellant charge.

15. The shotgun shell assembly of claim 14, further comprising:

a sabot that surrounds the projectile in the shotgun shell.

16. The shotgun shell assembly of claim 14, wherein the shotgun shell is 12-gauge.

17. A firearm cartridge comprising:

the projectile of claim 1;

a case; and a propellant charge, wherein the case and the projectile cooperate to contain the propellant charge.

18. A shotgun shell assembly comprising:

a firearm projectile comprising:

a jacket comprising a first piece and a second piece removably coupled to the first piece, wherein the jacket defines a front side on the second piece, a rear side on the first piece, an internal cavity and an opening in the front side of the second piece contiguous with the internal cavity;

a detonator positioned in the internal cavity defined by the jacket;

a striker having a first end and a second end, wherein the striker is positioned partially inside the internal cavity defined by the jacket, with the striker passing through the opening on the front side with the first end positioned outside of the internal cavity and with the second end positioned near the detonator inside of the internal cavity, wherein the striker is constructed and arranged to detonate the detonator when the striker impacts a target with sufficient force; and a main charge positioned within the internal cavity defined by the jacket, wherein the main charge and the jacket define an air-filled chamber located between the front side of the jacket and the main charge, wherein the striker extends into the main charge;

a shotgun shell; and a propellant charge.

19. The shotgun shell assembly of claim 18, further comprising:

a sabot that surrounds the projectile in the shotgun shell.

20. The shotgun shell assembly of claim 18, wherein the shotgun shell is 12-gauge.

21. A firearm cartridge comprising:

a firearm projectile comprising:

a jacket comprising a first piece and a second piece removably coupled to the first piece, wherein the jacket defines a front side on the second piece, a rear side on the first piece, an internal cavity and an opening in the front side of the second piece contiguous with the internal cavity;

a detonator positioned in the internal cavity defined by the jacket;

a striker having a first end and a second end, wherein the striker is positioned partially inside the internal cavity defined by the jacket, with the striker passing through the opening on the front side with the first end positioned outside of the internal cavity and with the second end positioned near the detonator inside of the internal cavity, wherein the striker is constructed and arranged to detonate the detonator when the striker impacts a target with sufficient force; and a main charge positioned within the internal cavity defined by the jacket, wherein the main charge and the jacket define an air-filled chamber located between the front side of the jacket and the main charge, wherein the striker extends into the main charge;

a case; and a propellant charge, wherein the case and the projectile cooperate to contain the propellant charge.

* * * * *